United States Patent [19]

Smith

[11] Patent Number: 4,802,419

[45] Date of Patent: Feb. 7, 1989

[54] STEERED AXLE FOR A RAILWAY VEHICLE

[75] Inventor: Roy E. Smith, Kingston, Canada

[73] Assignee: Urban Transportation Development Corporation, Toronto, Canada

[21] Appl. No.: 917,115

[22] Filed: Oct. 8, 1986

[51] Int. Cl.[4] ..... B61F 5/38

[52] U.S. Cl. ..... 105/171; 105/165; 105/176

[58] Field of Search ..... 105/165, 167, 168, 171, 105/176, 218.2

[56] References Cited

U.S. PATENT DOCUMENTS

| | | | |
|---|---|---|---|
| 736,318 | 8/1903 | Van Kirk | 105/165 |
| 800,035 | 9/1905 | Van Kirk | 105/167 |
| 1,094,822 | 4/1914 | Starbuck | 105/218.2 X |
| 1,232,918 | 7/1917 | Head | 105/165 |
| 1,954,705 | 4/1934 | Kruckenberg et al. | 105/171 |
| 2,030,010 | 2/1936 | Liechty | 105/3 |
| 2,071,207 | 2/1937 | Knecht | 105/165 |
| 2,800,320 | 7/1957 | Jarret et al. | 105/218.2 X |
| 2,961,974 | 11/1960 | Seelig, Jr. | 105/171 |
| 3,669,028 | 6/1972 | Joy | 105/157.1 |
| 4,162,653 | 7/1979 | Wickens | 105/166 |
| 4,285,280 | 8/1981 | Smith | 105/168 |
| 4,637,318 | 1/1987 | Paton | 105/167 |

*Primary Examiner*—Robert B. Reeves
*Assistant Examiner*—Scott H. Werny
*Attorney, Agent, or Firm*—Rogers, Bereskin & Parr

[57] ABSTRACT

An axle for a rail vehicle is pivotally connected to two equal length swinging arms, each of which is pivotally connected to the rail vehicle. The axle rotates about a virtual vertical axis away from the axle and nearer to the center of the rail vehicle. The axle is then radial for all curves over which a rail vehicle would usually traverse. In addition, the overhang of the rail vehicle while traversing a curve is reduced since the rail vehicle chords between virtual axes.

3 Claims, 5 Drawing Sheets

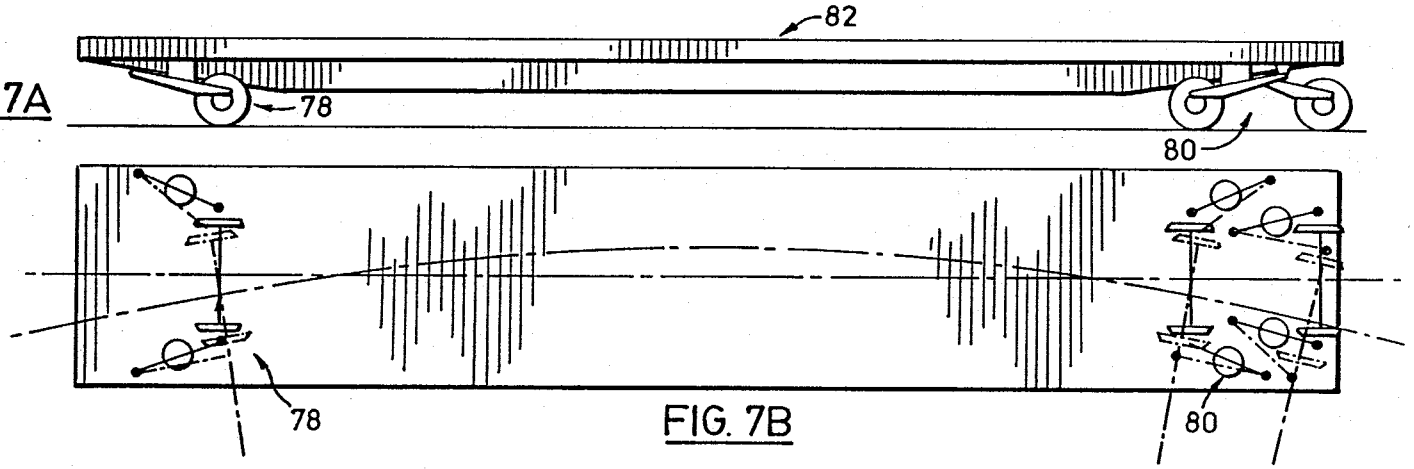
FIG. 7A
FIG. 7B
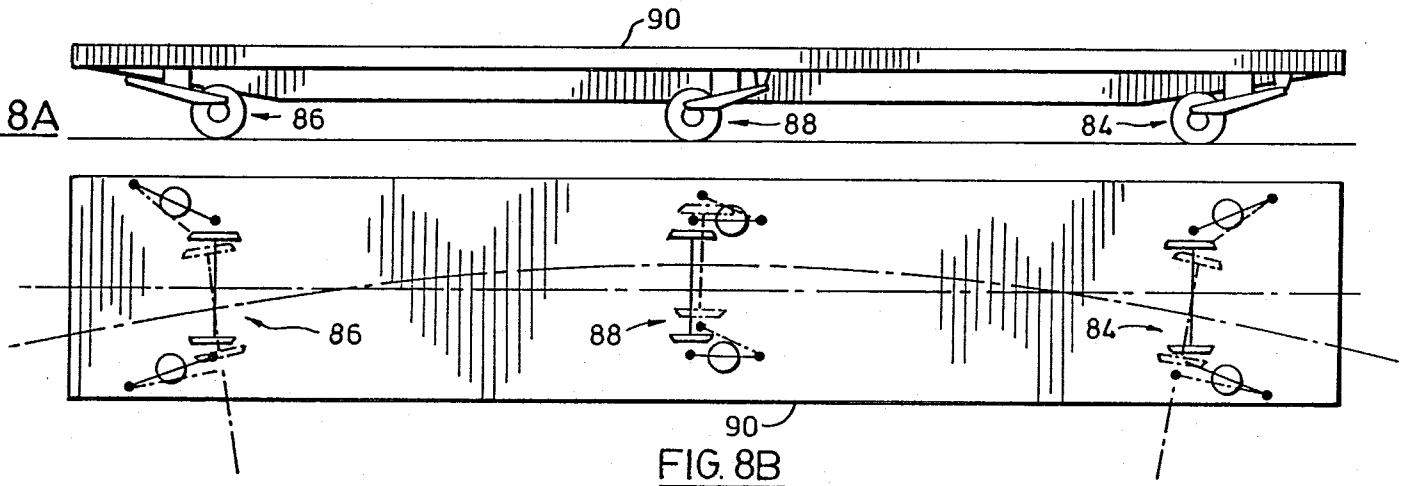
FIG. 8A
FIG. 8B

STEERED AXLE FOR A RAILWAY VEHICLE

FIELD OF THE INVENTION

This invention relates to wheel set and swinging arm assemblies for rail vehicles, particularly steered wheel set and swinging arm assemblies.

BACKGROUND OF THE INVENTION

A railway vehicle typically has axles mounted in pairs to form a truck at each end of the railway vehicle. The trucks typically pivot about a central axis of the truck midway between the two axles. When the vehicle traverses a curve, the vehicle chords across the curve from truck axis to truck axis.

This chording across the curve creates an overhang at the center of the truck over the rails, and the limit on the allowable overhang limits the permitted truck spacing. Also, the constraints of the usually rigid load bearing structure of the truck prevents the axles from moving into radial alignment with the curve, and it has previously been found difficult to overcome these constraints. If the wheels are not radially aligned on a curve, then the wheels are subject to increased instability and wear.

SUMMARY OF THE INVENTION

This invention provides a wheel set and swinging arm assembly which permits radial alignment of the axles of a rail vehicle on all curves usually encountered in practice, and reduces the overhang of the center of the railway vehicle betwene the axles while the rail vehicle is on a curve, without requiring a complex and cumbersome truck.

More particularly, this invention provides a rail vehicle having two wheel set and swinging arm assemblies, each wheel set and swinging arm assembly having a wheel set pivotally connected to one end each of two swinging arms of equal length, each of which swinging arms is pivotally connected at its other end to the rail vehicle, and in which the two wheel set and swinging arm assemblies are connected by a linkage so that the two wheel set and swinging arm assemblies cooperates and move conformably with each other, so as to provide added stability to the two wheel set and swinging arm assemblies.

The linkage comprises two rigid connecting arms pivotally connected to each other and to the adjacent swinging arms of the wheel set and swinging arm assemblies.

BRIEF DESCRIPTION OF THE DRAWINGS

Reference will now be made to the accompanying drawings which illustrate a preferred embodiment of the invention by way of example, and in which:

FIG. 7A is a side view of a rail vehicle with three wheel set and swinging arm assemblies asymmetrically arranged;

FIG. 7B is a plan view in schematic form showing a rail vehicle with three wheel set and swinging arm assemblies asymmetrically arranged as in FIG. 7A;

FIG. 8A is a side view of a rail vehicle with three wheel set and swinging arm assemblies symmetrically arranged; and FIG. 8B is a plan view in schematic form showing a rail vehicle with three wheel set and swinging arm assemblies symmetrically arranged as in FIG. 8A.

DESCRIPTION OF THE PREFERRED EMBODIMENT

A preferred embodiment will now be described with reference to the figures. As will be seen, a variety of combinations of wheel set and swinging arm assemblies with a rail vehicle are possible. For illustration of the principles of the invention, a single wheel set and swinging arm assembly will first be described.

SWINGING ARM CONSTRUCTION

Figure 1A:
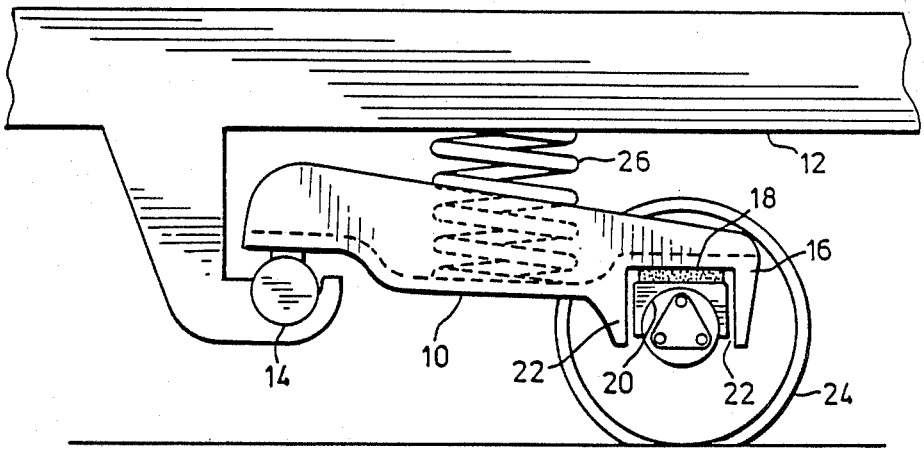
FIG. 1A is a side view of a wheel set and swinging arm assembly with part of a rail vehicle.

FIG. 1A shows a side view of the construction of the preferred embodiment of a single wheel set and swinging arm assembly according to the invention. Swinging arm 10 is pivotally connected to rail vehicle 12 by pivot means such as the ball and socket joint 14. Swinging arm 10 is free to rotate in a portion of the horizontal plane relative to the rail vehicle.

The swinging arm 10 is pivotally connected by pivot means to the wheel set 24 at its bearing housings 20 as follows.

End 16 of swinging arm 10 is U-shaped in a plane of cross-section perpendicular to the axle of the wheel set and rests on elastomeric pad 18 affixed to the top of the bearing housing 20. Side walls 22 of end 16 prevent excessive longitudinal movement of bearing housing 20 relative to swinging arm 10 so that the wheel set cannot slip out from under the swinging arms but are placed sufficiently far apart to allow rotation of the wheel set 24 in a portion of the horizontal plane. The degree of rotation required will depend on the expected degree of curvature of the track on which the rail vehicle will run.

Figure 1B:
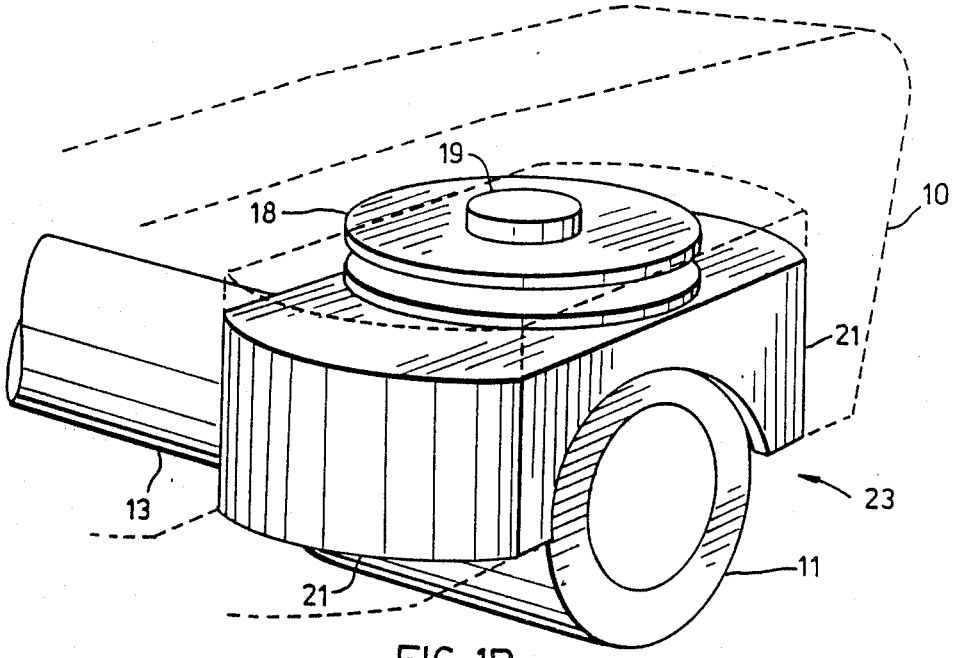
FIG. 1B is a perspective view of a swinging arm and bearing assembly.

FIG. 1B shows an example of the construction of the swinging arm connection to the bearing housing. Swinging arm 10 shown in ghost outline mates with the cylindrical locating surface 21 of the bearing housing 23 containing roller bearing assembly 11 and axle 13. In a central portion of the elastomeric pad 18 is a rigid locating peg 19 which mates with a corresponding female member (not shown) in the swinging arm 10. Instead of peg 19 and elastomeric pad 18, a conical elastomeric pad (not shown) with a vertical axis could also be used.

Figure 1C:
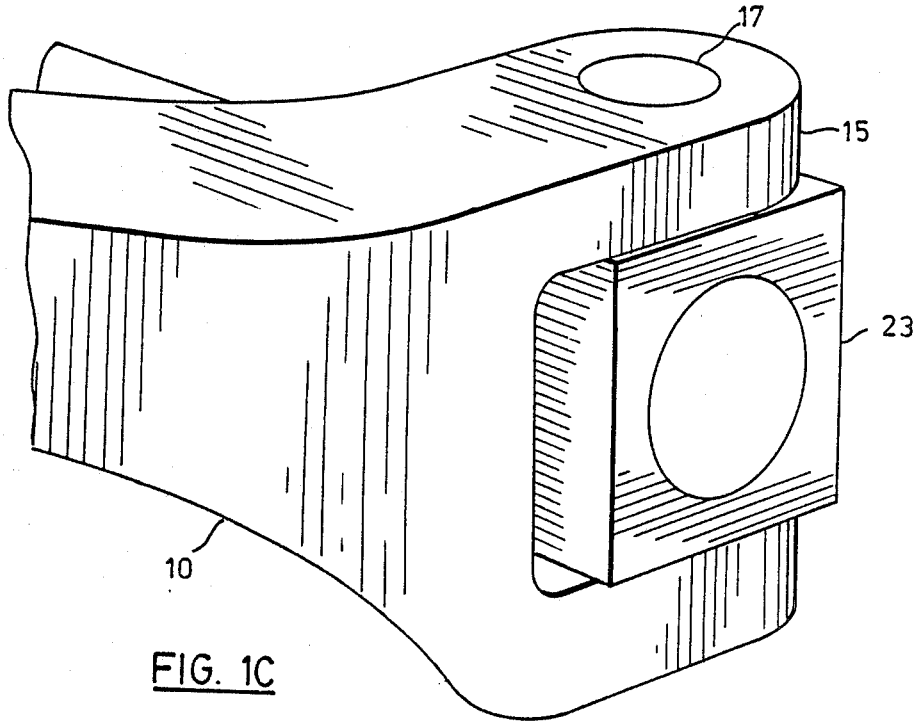
FIG. 1C is a perspective view of an alternative swinging arm and bearing assembly.

FIG. 1C shows another example of a swinging arm connection to the bearing housing. This clevis or fork arrangement cannot allow for angular misalignment so that if this arrangement were used such misalignments would have to be accounted for at the connection of the swinging arm to the rail vehicle. In FIG. 1C, clevis end 15 of swinging arm 10 mates with housing pivot pins 17 (one, not shown, at the base of the bearing housing). Each pivot pin 17 has a vertical axis. One pivot pin 17 is connected to the top of the bearing housing 23, and the other is connected to the bottom of bearing housing 23.

Referring to FIG. 1A, suspension spring 26 transmits the rail vehicle weight through the swinging arm 10 to the wheel set 24. Suspension spring 26 is connected at its upper end to the rail vehicle 12 and at its lower end to a mid-point on the swinging arm 10. The exact location of the suspension spring 26 on the swinging arm 10 is a matter of choice. Suspension spring 26, as would be understood by a person skilled in the art, should have sufficiently low horizontal stiffness to avoid unduly restraining the horizontal rotation of the swinging arm 10 about the ball and socket joint 14.

As would also be clear to a person skilled in the art, suspension spring 26 could be an elastomeric element or any other type of vertical spring means which would not unduly resist the movement in a horizontal plane of the swinging arm 10.

It will also be understood by a person skilled in the art that various equivalent joints and materials could be used for the ones described here. For example, the ball and socket joint 14 could be replaced by pins, or configurations other than those described here could connect the bearing housing 20 to swinging arm 10.

In the claims and disclosure, the swinging arm is described as being "connected" to the bearing housings. It will be understood that "connected" is a functional term that describes a connection that allows a certain degree of relative movement between the parts. Thus in the systems described here, where the swinging arm 10 rests upon bearing housing 20 and is prevented from excessive movement by the U-shaped end 16 of swinging arm 10 but is free to pivot about small angles, the swinging arm 10 is connected to the bearing housing 20.

Each wheel set 24 as described with reference to FIG. 1 has two swinging arms 10 (one not shown) attaching the wheel set 24 to the rail vehicle 12. The geometry of the two swinging arms 10 and wheel set 24 will now be described with reference to FIG. 2.

SWINGING ARM GEOMETRY

Figure 2:
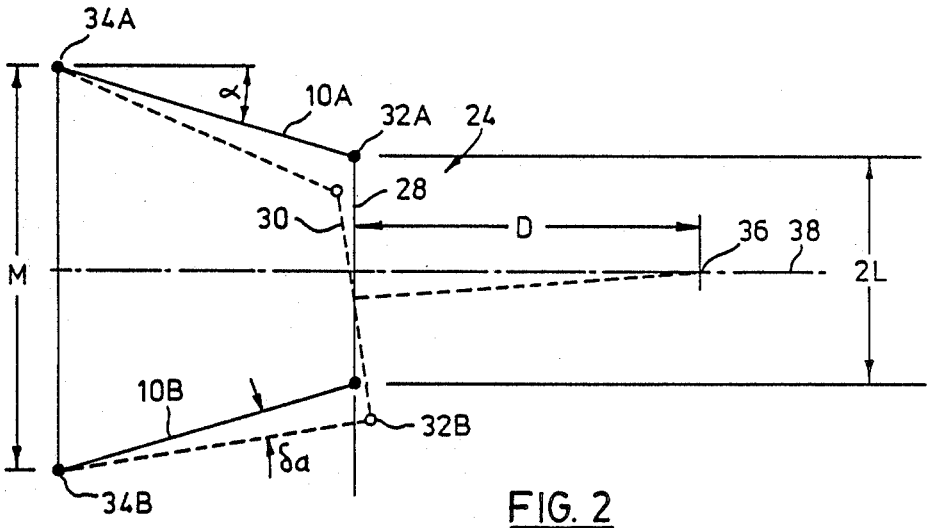
FIG. 2 is a diagram showing the geometrical confiquration of a wheel set and swinging arm assembly.

Referring to FIG. 2, swinging arms 10A and 10B are pivotally connected to axle 28 of wheel set 24 at pivot points 32A and 32B respectively, and pivotally connected to the rail vehicle (not shown) at pivot points 34A and 34B respectively.

As would be clear to a person skilled in the art, symmetry of the wheel set 24 in relation to the rail vehicle is desirable for the typical rail vehicle designed for motion in both directions along a track and for traversing left and right curves. Hence it is desirable that the pivot points 32A and 32B on the wheel set 24 be equidistant from the midpoint of the wheel set (defined in relation to the conical wheels) and that the pivot points 34A and 34B on the rail vehicle be equidistant from both the longitudinal center line of the rail vehicle and the chording center of the rail vehicle. The chording center of the rail vehicle is the point on the rail vehicle equidistant from the axes of rotation of two wheel sets on the rail vehicle (normally located near either end of the rail vehicle).

Swnging arms 10A and 10B are of equal length, and each may rotate about its respective pivot points 34A and 34B in a portion of the horizontal plane. The degree of allowable rotation in the horizontal plane will depend on the conditions of use of the rail vehicle, in particular the expected maximum curvature of the track upon which the rail vehicle will be used, although in normal commercial usage this curvature will have large radius and the required allowable rotation will be small.

In the configuration shown in FIG. 2, axle 28 rotates in a horizontal plane about a virtual vertical axis 36 whose location will depend on the relative distances between the pivot points 32A and 32B and the pivot points 34A and 34B.

In the configuration shown, the distance, 2L, between pivot points 32A and 32B is less than the distance M between pivot points 34A and 34B. Throughout this patent when a distance 2L is referred to in relation to a wheel set and swinging arm assembly, this distance means the distance between the pivot points on the wheel set. Similarly, whenever the distance M is referred to in relation to a wheel set and swinging arm assembly it means the distance between the pivot points of the swinging arms where they attach to the rail vehicle.

Geometrical analysis shows that for curves of large radius as will be encountered in practice the virtual vertical axis 36 about which the axle 28 rotates will be located at the intersection of the geometric extensions of the xes of the swinging arms 10A and 10B. When the rail vehicle is on straight track this point of intersection will be on the longitudinal center line of the rail vehicle.

In the figure, $\alpha$ is the angle between the swinging arm 10A or 10B and longitudinal center line 38, and D is the distance from the axle 28 to virtual axis 36.

When the rail vehicle (not shown) traverses a curve, the axle 28 will move to the location indicated in ghost outline at 30, and the swinging arms 10A and 10B will rotate through a small angle $d\alpha$. The greater the radius of curvature of the track, the smaller the angle $d\alpha$. The movement of the axle 28 shown here corresponds to the rail vehicle traversing a curve whose center of curvature is located below FIG. 2.

Geometrical analysis shows that for small angles $$\frac{L}{\tan\alpha} = D$$

Hence D, the distance from the axle 28 to its virtual axis of rotation 36, depends only on the length of the axle 28 between pivot points 32A and 32B and the magnitude of the angle $\alpha$ between each of the swinging arms 10A and 10B to the longitudinal center line, which angle depends only on the ratio of the length of the swinging arms to the difference between M/2 and L.

Once a desired axis is chosen, the location of the axle 28 and the swinging arms 10 are a matter of choice. The axle 28 may be on either side of the axis, or closer to or further away from the axis than the pivot points 34A and 34B on the rail vehicle. For a given axle width 2L, the location of the pivot points 34A and 34B may be varied by varying M and the length of the swinging arms 10.

The symmetrical arrangement of the pivot points 34A and 34B ensures that the virtual axis 36 is on the longitudinal center line of the rail vehicle.

If, for any axle 28, 2 L is less than M, the virtual axis 36 will be nearer the pivot points 32A and 32B than to the pivot points 34A and 34B. In operation, where an axle 28 and two swinging arms 10A and 10B are at one end of the rail vehicle, it is desirable that the virtual vertical axis 36 be closer to the chording center of the rail vehicle than the axle 28. This ensures that the axle 28 will be steered by the motion of the rail vehicle relative to the axle 28 and two swinging arms 10A and 10B into radial configuration when the rail vehicle is on a curve.

If 2 L is greater than M then, where it is desirable that the virtual axis be closer to the chording center of the rail vehicle than the axle 28, axle 28 will be located further away from the center of the rail vehicle than the pivot points 34A and 34B.

If 2 L=M then it is clear from FIG. 2 that the axle 24 will rotate about an infinitely distant virtual vertical axis. That is, the axle will remain perpendicular to the longitudinal center line while the vehicle is on a curve. This configuration, therefore, is of particular use at the center of a rail vehicle, where only the lateral shift of the rail vehicle across the rails need be accounted for. Clearly the pivot points 34A and 34B must be squarely aligned otherwise the axle will not be radially aligned for any curve.

TRACK-VEHICLE GEOMETRY

Figure 3:
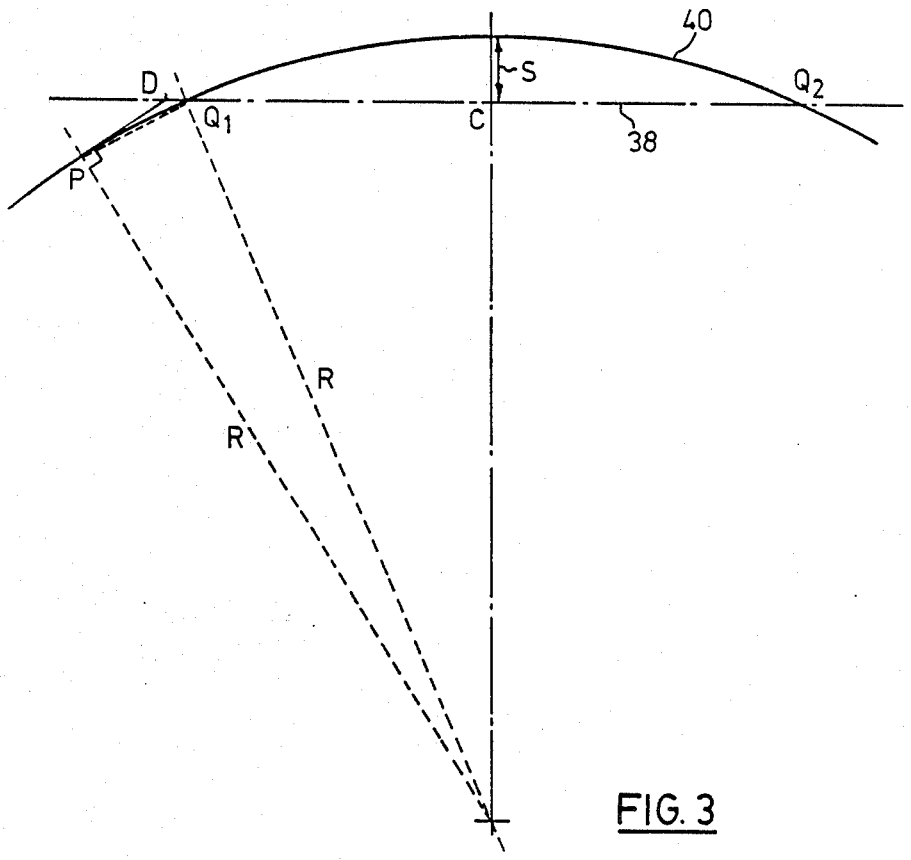
FIG. 3 is a diagram showing the track and vehicle geometry for a rail vehicle having at least two wheel set and swinging arm assemblies.

In operation, referring to FIG. 3, a rail vehicle (not shown) will be supported by at least two axles, one at each end of the rail vehicle (one at P, the other not shown), and as the vehicle traverses a curve on a track with radius R (whose curved center line is shown at 40), the vehicle will span the chord along the longitudinal center line 38 of the rail vehicle between the intersections of the track center line 40 and the longitudinal center line 38 ($Q_1$ and $Q_2$). The axle at P rotates about a virtual vertical axis located at D defined by the intersection of the horizontal center line 38 of the rail vehicle and the tangent at P to the center line 40 of the track. It can be shown that the location of D depends only on the distance from P to the chording center C of the rail vehicle and the distance from $Q_1$ to the chording center C. For curves of large radius D will be very close to $Q_1$.

The distance S at the center of the rail vehicle between the track centerline 40 and longitudinal center line 38 will be less than if the axles (one at P) rotated about axes passing through the axles. Thus there will be less overhang of the vehicle on the track and the envelope of the vehicle would be reduced. In addition, the swinging arm geometry described ensures that for any curve, as the vehicle chords around the curve, the axle in rotating about its virtual axis is steered by the rail vehicle's forces into radial alignment with the curve of the track.

LINKED SWINGING ARMS

In some circumstances, additional stabilizing of the swinging arms may be required, depending on the application and the configuration of the assembly. Extreme ratios of 2 L and M, for example, may lead to instability. In cases of instability, however arising, it is desirable to add a stabilizing mechanism.

Figure 5:
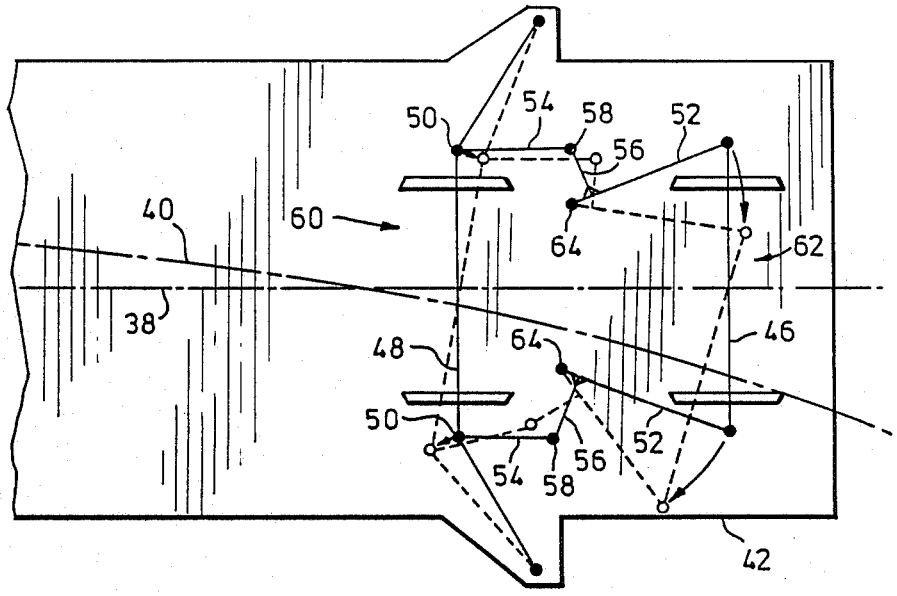
FIG. 5 is a diagram showing the geometrical configuration of a pair of wheel set and swinging arm assemblies with a stabilizing linkage.

FIG. 5 shows a rail vehicle 42 having a pair of axles 46 and 48, in which M is much greater than 2 L for axle 48 and M is much less than 2 L for axle 46. To increase the stability of this axle pair 46, 48 a linking mechanism is added so that the axles rotate conformably with each other as follows.

Rigid arms 54 are pivotally attached, for example by ball and socket joints, at one end each of the arms 54 to the wheel set and swinging arm assembly 60 near the pivot points 50. The other end of each arm 54 is pivotally attached, by for example ball and socket joints, at pivot points 58 to rigid arms 56. Each rigid arm 56 is rigidly attached to the wheel set and swinging arm assembly 62 near the pivot points 64.

This mechanism tends to average out the disturbances caused by small elastic deformations and adds stability to the axle pair. That is, the linkage requires that the wheel set and swinging arm assemblies 60 and 62 cooperate with one another or, equivalently, rotate conformably with each other, so that whenever one wheel set moves, the other wheel set must also in a corresponding direction.

Variations of the linking mechanism within the spirit of the invention include attaching the rigid arms at various points on the wheel set and swinging arm assemblies 60 and 62.

FOUR AXLE VEHICLE

Figure 4A:
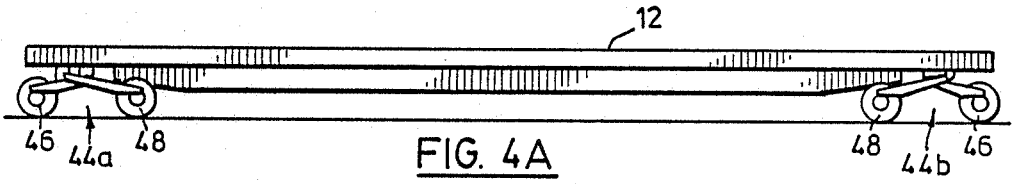
FIG. 4A is a side view of a rail vehicle with two pairs of wheel set and swinging arm assemblies.
Figure 4B:
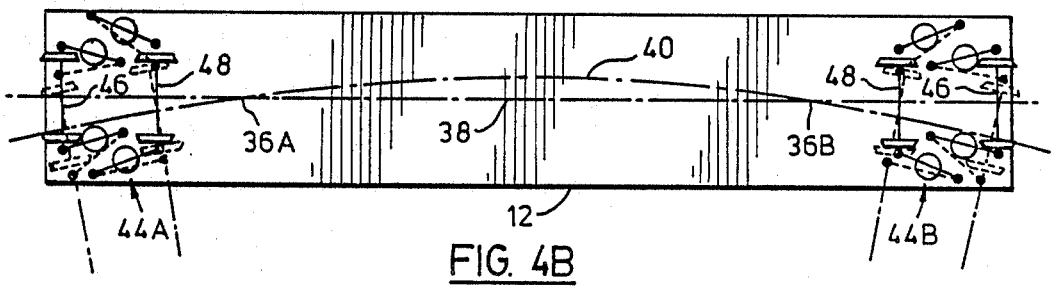
FIG. 4B is a plan view in schematic form showing a rail vehicle with two pairs of wheel set and swinging arm assemblies as in FIG. 4A.

FIGS. 4A and 4B show the case of a four axle vehicle 12 with pairs of wheel set and swinging arm assemblies 44A and 44B according to the invention. Each pair of assemblies 44A and 44B consists of an axle 48 with 2 L less than M and an axle 46 with 2 L greater than M.

In operation, on a curve, as shown in ghost outline in FIG. 4B, each axle 46, 48 will be forced by the motion of the rail vehicle into radial alignment with the curve 40 the longitudinal center line 38 of the rail vehicle will cross the track center line 40 at the points 36A and 36B, close to the virtual axes (not shown, but see FIG. 3 for their location) of the axles 46, 48, thus reducing the overhang of the rail vehicle at its center.

Each axle 46, 48 of each pair of axles 44A and 44B has the same virtual axes, not shown, close to the points 36A and 36B respectively. Combining the axles 46 and 48 in the pairs shown permits the axles to be arranged with maximum economy of space. That is, 2 L is less than M for each axle 48 and 2 L is greater than M for each axle 46. Clearly, a variety of arrangements are possible to obtain the required virtual axis.

THREE AND FIVE AXLE VEHICLES

Figure 6A:
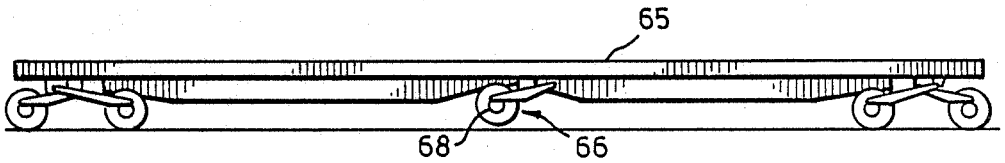
FIG. 6A is a side view of a rail vehicle with five wheel set and swinging arm assemblies.
Figure 6B:
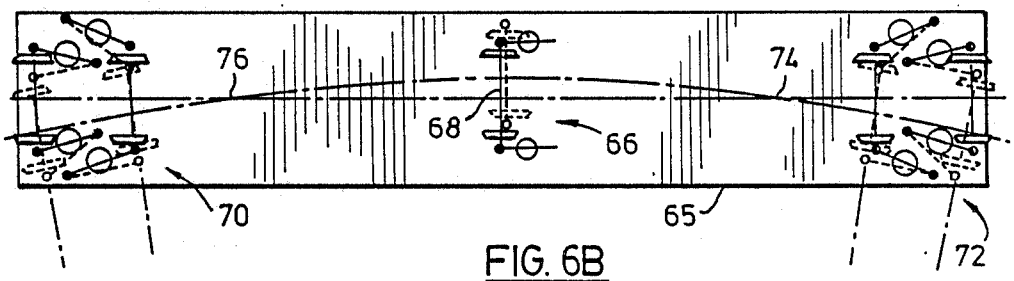
FIG. 6B is a plan view in schematic form showing a rail vehicle with five wheel set and swinging arm assemblies as in FIG. 6A.

Various combinations of wheel set and swinging arm assemblies are possible with one rail vehicle. A five axle version on a rail vehicle 65 is shown in FIGS. 6A and 6B. The center wheel set and swinging arm assembly 66 has 2 L=M so that the axle 68 may move laterally as the center of the rail vehicle moves across the rails on a curve. Wheel set and swinging arm assemblies 70 and 72 are similar to assemblies 44A and 44B as described in FIGS. 4A and 4B, having virtual axes (not shown) close to the points 74 and 76 respectively.

Three axle versions are shown in FIGS. 7A, 7B and 8. FIGS. 7A and 7B show an asymmetric version in which wheel set and swinging arm assembly 78 and the pair of wheel set and swinging arm assemblies 80 are mounted on rail vehicle 82 each according to the invention. Similarly FIGS. 8A and 8B show a three axle version with end wheel sets 84 and 86 with 2 L less than M and center wheel set 88 with 2 L=M, each mounted on rail vehicle 90.

This invention permits multiple axles to be added easily because even though the rail vehicle center moves laterally across the rails, the wheel set and swinging arm assemblies described in this patent are capable of swinging to accommodate the lateral shift.

Multiple axle versions allow lighter axle loads, hence reduced wheel size. Reduced wheel size allows lower platform height and greater stability. Reduced distance between axles also means lower structural strength required in the platform, hence reduced weight of the platform.

VEHICLE LINKS

When vehicles with axles according to the invention are linked together lateral forces exerted by the vehicles on each other when traversing a curve will tend to disturb the axial alignment of the wheel sets. It is desirable, therefore, that a linking mechanism be used that does not exert lateral forces on the adjacent vehicles. Such linkages are known in the art and need not be described here.

Any linkage that directly connects adjacent rail vehicles to transmit longitudinal forces will also transmit lateral forces and tend to disturb the radial alignment of the wheel sets. In such a case it is desirable to add connecting linkages described above in relation to FIG. 5 which are capable of withstanding both the lateral forces transmitted by adjacent vehicles and dynamic lateral forces to ensure radial steering.

The preferred embodiment of the invention described here is by way of example, and is not intended to be exhaustive of the ways of constructing the invention.

I claim:

1. A rail vehicle, having first and second wheel set and swinging arm assemblies, each wheel set and swinging arm assembly comprising:

a wheel set;

a first swinging arm having two ends, pivotally connected at one end to the rail vehicle to form a first pivot point and pivotally connected at the other end to the wheel set to form a second pivot point;

a second swinging arm of equal length to the first swinging arm and having two ends, pivotally connected at one end to the rail vehicle to form a third pivot point and pivotally connected at the other end to the wheel set to form a fourth pivot point;

each of the swinging arms being capable of supporting a proportion of the rail vehicle weight;

first, second, third and fourth spring means disposed between the rail vehicle and each of the swinging arms, respectively, for supporting the rail vehicle on each of the wheel set and swinging arm assemblies, each of the spring means being disposed on its respective arm between the pivot points on the swinging arm; and a connecting linkage between the first and second wheel set and swinging arm assemblies, the connecting linkage including a first rigid connecting arm pivotally conncted to the first swinging arm of the first wheel set and swinging arm assembly, a second rigid connecting arm rigidly connected to the longitudinally adjacent swinging arm of the second wheel set and swinging arm assembly, and the first and second rigid connecting arms being pivotally connected to each other so that the wheel set and swinging arm assemblies rotate conformably with each other.

2. The rail vehicle and first and second wheel set and swinging arm assemblies of claim 1 further comprising:

a third rigid connecting arm pivotally connected to the second swinging arm of the first wheel set and swinging arm assembly; and a fourth rigid connecting arm rigidly connected to the swinging arm of the second wheel set and swinging arm assembly longitudinally adjacent to the second swinging arm of the first wheel set and swinging arm assembly, the third and fourth rigid connecting arms being pivotally connected to each other so that the two wheel set and swinging arm assemblies rotate conformably with each other.

3. In combination with a rail vehicle, a first and second wheel set and swinging arm assembly, each wheel set and swinging arm assembly comprising:

a wheel set;

a first swinging arm having two ends, pivotally connected at one end to the rail vehicle to form a first pivot point and pivotally connected at the other end to the wheel set to form a second pivot point;

a second swing arm of equal length to the first swinging arm and having two ends, pivotally connected at one end to the rail vehicle to form a third pivot point and pivotally connected at the other end to the wheel set to form a fourth pivot point;

spring means for supporting the rail vehicle on the wheel set and swinging arm assembly; and a connecting linkage between the wheel set and swinging arm assemblies including a first rigid connecting arm pivotally connected to the first swinging arm of the first wheel set and swinging arm assembly, a second rigid connecting arm rigidly connected to the longitudinally adjacent swinging arm of the second wheel set and swinging arm assembly, and the first and second rigid connecting arms being pivotally connected to each other so that the two wheel set and swinging arm assemblies rotate conformably with each other.

* * * * *